US006994639B2

(12) United States Patent
Parks et al.

(10) Patent No.: US 6,994,639 B2
(45) Date of Patent: Feb. 7, 2006

(54) GOLF DIVOT TOOL AND ACCESSORY

(76) Inventors: Dennis Parks, 5 burning Tree, Laguna Niguel, CA (US) 92677; Martin Ogle, 370 Ledroit St., Laguna Beach, CA (US) 92651

( * ) Notice: Subject to any disclaimer, the term of this patent is extended or adjusted under 35 U.S.C. 154(b) by 0 days.

(21) Appl. No.: 10/888,139

(22) Filed: Jul. 9, 2004

(65) Prior Publication Data

US 2006/0009313 A1 Jan. 12, 2006

(51) Int. Cl.
*A63B 57/00* (2006.01)

(52) U.S. Cl. ..... 473/408; 473/406

(58) Field of Classification Search ..... 473/406, 473/408, 286, 282; D21/793; 131/175
See application file for complete search history.

(56) References Cited

U.S. PATENT DOCUMENTS

| | | | | |
|---|---|---|---|---|
| 5,305,999 | A | 4/1994 | Tate | |
| 5,643,114 | A | 7/1997 | Marcus | |
| D385,940 | S | 11/1997 | Justice | |
| 5,706,831 | A | 1/1998 | Whitbeck | |
| D390,904 | S | 2/1998 | Newbold | |
| D392,362 | S | 3/1998 | Ridgeway | |
| 5,743,276 | A | 4/1998 | Tamayo-Rivera et al. | |
| 5,755,629 | A * | 5/1998 | Blomgren | 473/408 |
| 5,759,120 | A | 6/1998 | Mathis et al. | |
| 5,816,262 | A * | 10/1998 | Javnozon | 131/175 |
| 5,853,336 | A * | 12/1998 | Hufgard | 473/408 |
| 6,022,280 | A | 2/2000 | Arenburg et al. | |
| D424,151 | S * | 5/2000 | Miura | D21/793 |
| 6,234,916 | B1 | 5/2001 | Carusillo et al. | |
| 6,363,941 | B1 | 4/2002 | Combs | |
| 6,514,159 | B2 * | 2/2003 | Hendren | 473/408 |
| 6,565,458 | B1 * | 5/2003 | Cameron | 473/408 |
| 6,572,495 | B1 * | 6/2003 | Ferrari | 473/408 |
| 2001/0029213 | A1 | 10/2001 | Hendren | |
| 2003/0071096 | A1 | 4/2003 | Berdan | |
| 2003/0104881 | A1 | 6/2003 | Ferrari | |

* cited by examiner

*Primary Examiner*—Steven Wong
(74) *Attorney, Agent, or Firm*—Daniel L. Dawes; Myers Dawes Andras & Sherman

(57) ABSTRACT

A golf accessory usable in combination with a ferromagnetic surface and in combination as a rest for an object is comprised of a fixed plate defining at least one descending leg serving as a divot tool and a hinged plate rotatably coupled to the fixed plate. A rigid tab extends from the hinged plate and us rotatable to a position in contact against the fixed plate to act as a as a lever to assist in rotation of the hinged plate and to act as a stop to define a fixed dihedral angle between the fixed and hinged plates when in an open configuration to serve as the rest for the object. A magnet is disposed through the fixed plate for providing magnetic attachment of the fixed plate to the ferromagnetic surface. A ball marker is magnetically coupled to the magnet.

20 Claims, 5 Drawing Sheets

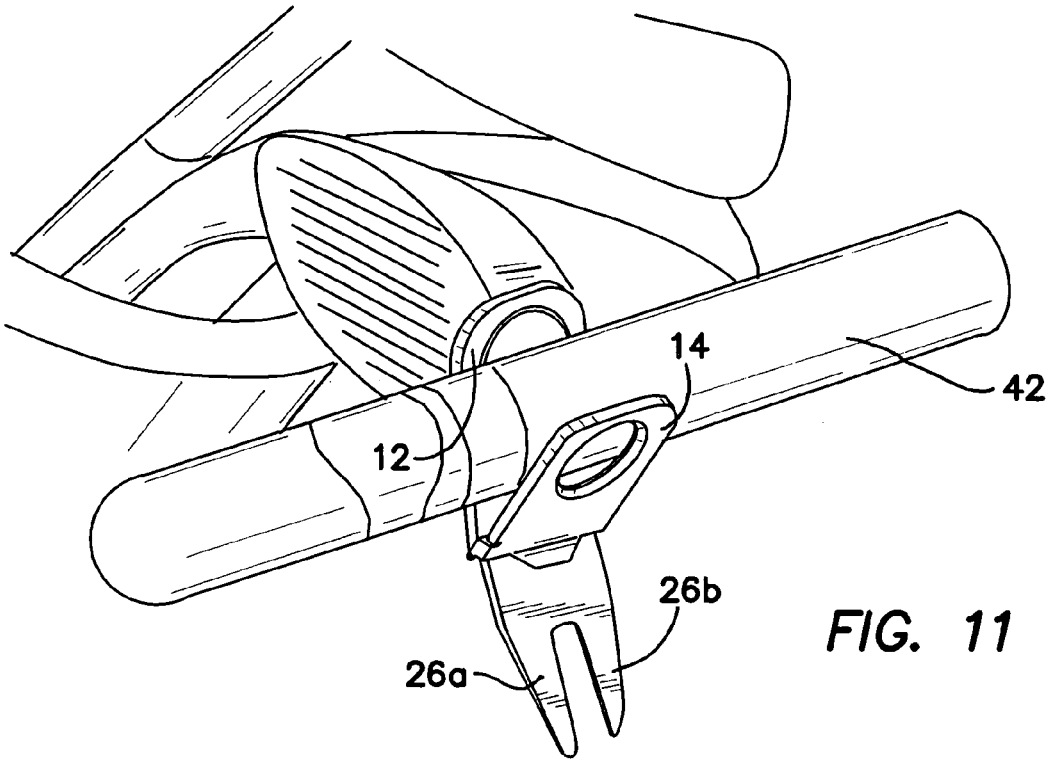
FIG. 11
FIG. 12
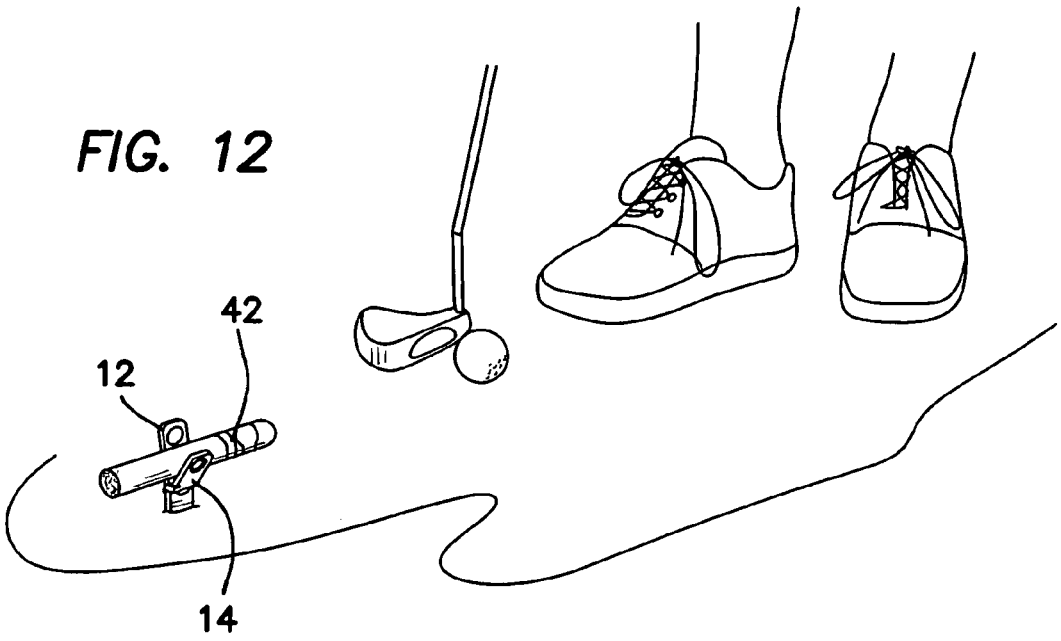

GOLF DIVOT TOOL AND ACCESSORY

BACKGROUND OF THE INVENTION

1. Field of the Invention

The invention relates to the field of golf equipment and in particular to multiple purpose divot tools.

2. Description of the Prior Art

Tate U.S. Pat. No. 5,305,999 describes a golf accessory which has a flat, planar, disc shaped metal shield from the edge of which a pair of legs extend downwardly in a generally parallel fashion to form a divot tool. Opposite the legs there is a projection from the metal shield defining a transverse groove running at right angles to the plane of the legs and shield. The groove is of a size suitable for cradling a cigarette. The projection is formed as a return bent back in a loop to extend parallel to and behind the metal shield. The projection and shield form a single piece rigid unit.

A leaf spring is secured to the surface of the return facing the shield and is resiliently deflected to receive varying thicknesses of bills or other papers. The return and the shield are each also provided with recessed regions in which magnets are mounted to receive disc shaped ball markers in the recessed regions. The ball markers are firmly held by magnetic attraction in the recessed regions atop the magnets, but can be removed therefrom.

In another embodiment rather than being formed as a lopped return, the projection may reside solely in the plane of the shield and form a pair of straight ears on either side of the groove. The ears are narrow or sharp enough to fit into the grooves in the face of a golf club so that the tool can be used to clean those grooves.

Newbold et. al. Des.390,904 shows a divot tool having two descending legs for the divot tool from a planar body in which a magnet is embedded to attach a circular ball marker.

Ferrari, U.S. Application 2003/0104881 shows a multi-purpose golfer's tool including a retractable ball-mark repair blade and a cigar cutter. The housing for the tool has a central opening adapted to receive the end of a cigar. The ball-mark repair blade is actuated by a lever arm that is secured to the blade by means of, e.g., a hinge. The lever arm is adapted to present a smooth flush surface with the housing when the blade is retracted. The lever arm may also include a magnet so as to removably secure a magnetic or magnetizable ball marker to the tool.

Whitbeck U.S. Pat. No. 5,706,831 discloses a golf tool including a ball mark repair tool for repairing ball marks in turf. A cigar support comprised of a hinged lever is coupled to the ball mark repair tool for supporting a cigar such that neither end of the cigar is in contact with the turf.

Marcus U.S. Pat. No. 5,643,114 is directed to a golf accessory which is a combined ball-mark repairer and cigar cutter and/or holder. In a first embodiment the device includes a ball mark repairer at one end and a cigar cutter located at the other end. The device includes a sliding mechanism whereby the cigar cutter can be actuated by pulling on one end of the device while holding the other end of the device firmly. The device may optionally include projections for firmly embedding the device in the ground to provide a cigar holder for a golfer and may optionally include a ball marker as well associated magnetically with the golf accessory.

Mathias et. al. U.S. Pat. No. 5,759,120 shows a multi-function golfer's cigar tool includes a body with a cigar cutter having a blade movably mounted therein, an arrangement for repairing a ball mark on a golf course associated with the body, a cigar support stand and a golf club support stand.

Justice U.S. Des. 385,940 depicts a divot tool in which the legs descend from a cylindrical cup which serves as a cigar holder.

Ridgeway U.S. Des. 392,362 depicts a divot tool in which the legs descend from a circular body on top of which is provided a prismatic U-shaped cradle for holding a cigarette or cigar.

Combs U.S. Pat. No. 6,363,941 discloses a cigar holder fashioned from a conventional large size 50 mm "binder clip" modified in a way to hold various sizes of cigars between the opposed gripping means above the clamping element. The cigar holder includes a clamping element, a pair of opposed gripping means which when pressed together, open the clamping element for securing the device to any stationary surface 20 mm in diameter or less within the clamping elements. The improvement comprising two bends in the opposed gripping means forming a shape that will receive and hold a cigar or golf club.

Hendren U.S. Patent Application 2001/0029213 is directed to a multi-purpose golf tool including a body member equipped with means for selectively supporting a plurality of golf club grips off a golf playing surface. An elongate base extends from the bottom of the body member for engaging the golf playing surface.

Berdan U.S. Patent Application 2003/0071096 shows a compact golf accessory organizer with a multi-mounting, universal functioning clip, which can attach to several different items. The common items for attachment include a golfer's golf bag, golf cart visor, clothing waistband, belt, pockets, and the like. The compact organizer contains a vac-form with impressions that mold around the included articles. This is specifically designed to only hold the following articles: four tees, two ball markers, and a universal tool which consists of a divot repair, a spike tightening device, a club cleaner and cigar holder. These items are included in the golf accessory organizer. The compact size of the organizer allows it to be stored in a golfer's shirt or pant pocket, or the user can attach it to their waistband without obstructing the golfers swing. This organizer will free up the golfers pockets and conveniently organize the common items used during the game of golf.

Arenburg et. al. U.S. Pat. No. 6,022,280 discloses a multiple purpose golf tool which includes a planar body portion having top and bottom ends. A pair of elongated leg members extend from the bottom end of the body portion for loosening sod on the greens of a golf course for repairing divots. A pair of reversely bent spaced shoulder members extend rearwardly from the top end of the body portion communicating with a solid plate portion in spaced generally parallel relation to the body portion. A fork shaped plate is hingedly attached to the terminal end of the solid plate portion and is movable between a closed clamping position wherein an edge thereof bears against the body portion for use as a money clip, and an open position wherein the fork shaped plate extends away from the body portion for use as a golf shoe cleat tightener.

Tamayo-Rivera et. al. U.S. Pat. No. 5,743,276 describes a cigar caddie divot repair tool comprised of a ball mark repairer for repairing dents and divots in a golf green, which repairer is hingedly interconnected to a tray body to selectively and releasably achieve a closed position wherein the ball mark repairer is substantially parallel to the tray body or an open position wherein said ball mark repairer is substantially perpendicular to the tray body. The tray body can support of a cigar, cigarette, or other object placed thereon and may serve as a grip concavity suited to receive a user's thumb when the ball mark repairer is being used to repair turf.

Carusillo et. al. U.S. Pat. No. 6,234,916 describes a multi-task golf tool comprising a body portion and a stem portion attached to the body portion. The body portion has a channel extending therethrough and which is sized for receiving a portion of a golf club. The body portion further includes a pair of walls wherein each wall is on a respective side of the channel and has a distal end. Each wall has a cut-out in the distal end thereof which is sized for receiving a portion of a smoking article. Each of the cut-outs has a parametrical edge. The cut-outs are positioned directly opposite one another such that when a portion of a golf club is positioned within the channel and a smoking article is positioned within the cut-outs, the smoking article is transverse to the golf club. The stem portion has a distal end having a plurality of tines attached thereto. The golf tool further comprises a resilient member that has a first end attached to the parametrical edge and is expandable within one of the cut-outs. The resilient member has a second end for contacting a smoking article. The golf tool further comprises a clip attached to the stem so as to allow the golf tool to be removably attached to other objects.

A simplified, easily manufactured, yet rugged design is needed whereby each of the multiple functions served by the above golf accessories can be performed with the additional functional feature a more versatile and convenient means for attaching the golf accessory to something other than just staking it to the ground or mechanically clipping the golf accessory to another object.

BRIEF SUMMARY OF THE INVENTION

The illustrated embodiment of the invention is a golf accessory usable in combination with a ferromagnetic surface and in combination as a rest for an object comprising a fixed plate defining at least one descending leg serving as a divot tool and a hinged plate rotatably coupled to the fixed plate. A rigid tab extends from the hinged plate and us rotatable to a position in contact against the fixed plate to act as a as a lever to assist in rotation of the hinged plate and to act as a stop to define a fixed dihedral angle between the fixed and hinged plates when in an open configuration to serve as the rest for the object. A magnet is disposed through the fixed plate for providing magnetic attachment of the fixed plate to the ferromagnetic surface. A ball marker is magnetically coupled to the magnet.

The magnet is disposed through the fixed plate to provide an available magnetic surface of direct contact with the magnet on the back surface of the fixed plate. The magnet is also disposed above the front surface of the fixed plate to provide a pedestal to which the ball marker can be magnetically coupled.

The hinged plate has a beveled recess defined therethrough through which the magnet is exposed on the front surface of the fixed plate, through which beveled recess the ball marker is received and magnetically coupled to the magnet.

In the preferred embodiment the fixed and hinged plates are laser cut stainless steel plate, and further comprising a pair of pins formed on the fixed plate to which the hinged plate is rotatably coupled when assembled thereto. However, it is to be expressly understood that any rigid material of sufficient strength for the application disclosed may be employed in place of stainless steel, including but not limited to aluminum, precious metals, other metals and alloys, metallized plastics, or plastics. However, the fixed and hinged plates could also be cut by other means, such as high pressure waterjet cutting. The hinged plate includes a pair of arms and is assembled onto the fixed plate by bending the pair of arms having pivot holes defined therein over the pair of pins.

The fixed plate is comprised of a lower portion and an upper portion and the hinged plate is assembled parallel to the upper portion. The lower portion of the hinged plate is angled with respect to the upper portion in a predetermined direction, and the tab is angled with respect to the hinged plate in the same predetermined direction. The angle of inclination of the tab with respect to the hinged plate is greater than of the inclination of the lower and upper portions of the fixed plate with respect to each other, so that a defined dihedral angle is defined and supported between the hinged plate and the upper portion of the fixed plate, when the golf accessory is configured in the open configuration.

In the illustrated embodiment the fixed plate comprises two descending legs to serve as the divot tool, although the divot tool take any form now know or later devised for such tools.

It is intended that the object which is held by the golf accessory comprises a smoking product requiring maintenance of a sanitary condition, such as a cigar, cigarette or pipe. However, the object is also contemplated as including a golf club grip or shaft.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

FIG. 11 is a perspective view of the golf accessory of the invention shown is use holding a cigar and magnetically attached to a golf club head.

FIG. 12 is a perspective view of the golf accessory of the invention shown is use holding a cigar and fixed into the ground.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1:
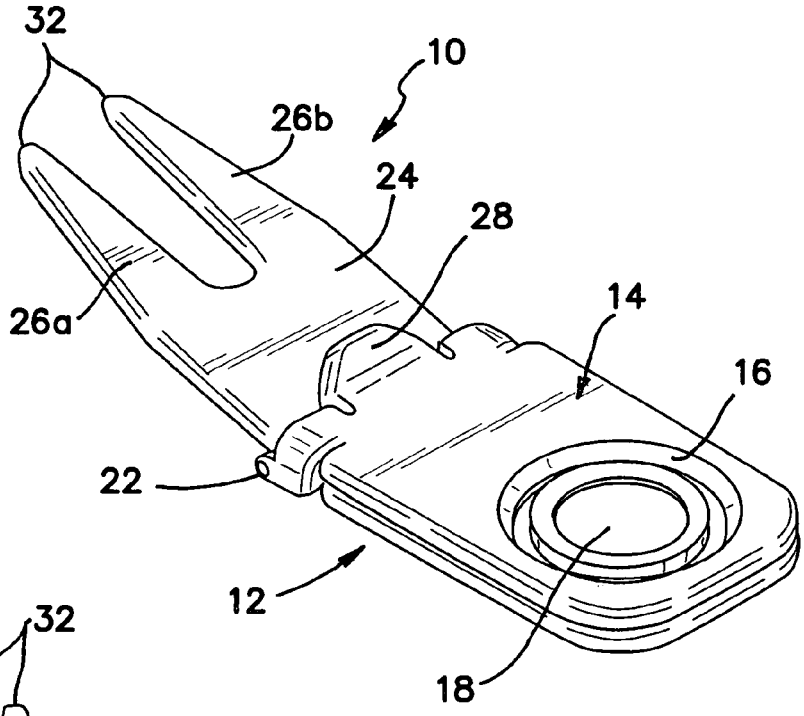
FIG. 1 is a perspective view of the golf accessory of the invention.

FIG. 1 is a perspective view of the golf accessory of the invention, generally denoted by reference numeral 10. Golf accessory 10 is comprised of a fixed plate 12 and a hinged plate 14 rotatably coupled to fixed plate 12. Hinged plate 14 has a beveled circular hole 16 defined therethrough allowing a ball marker 18 to be disposed in hole 16 and magnetically coupled to fixed plate 12. As will be shown in FIG. 2 fixed plate 12 has a permanent magnet 20 fixed therein which serves to magnetically couple to marker 18 which is preferably ferromagnetic, or may also be magnetized. Marker 18 may carry an arbitrary design embossed into it or otherwise applied to it.

In the preferred embodiment golf accessory 10 is composed of heavy gauge, laser-cut, polished or buffed stainless steel which provides a comfortable weight in the hand, is rigid so that it can be used as a prying tool without flexing, is corrosive resistant and provides an aesthetic appearance.

Figure 3:
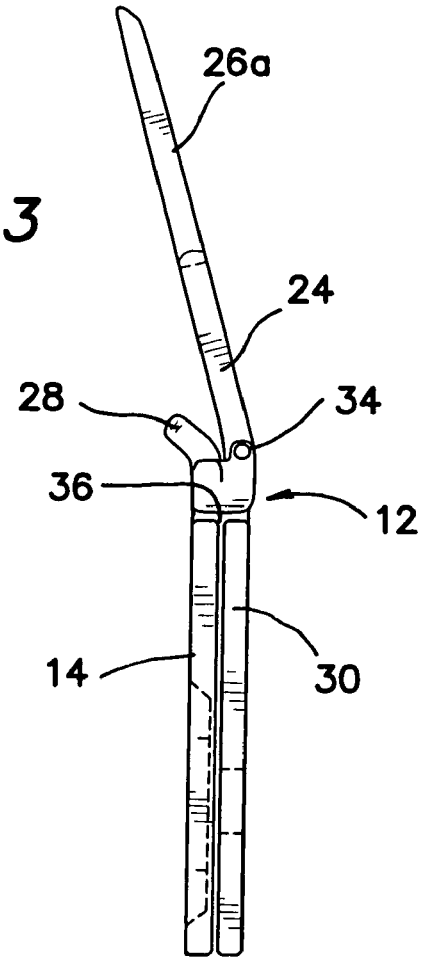
FIG. 3 is a right or left side elevational view of the golf accessory of the invention.
Figure 4:
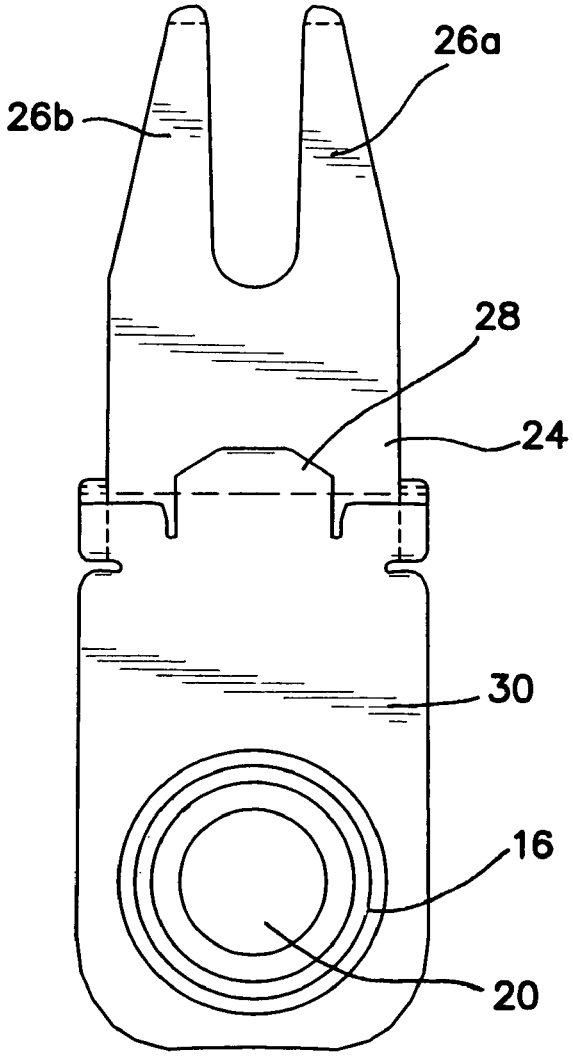
FIG. 4 is a front elevational view of the golf accessory of the invention.
Figure 5:
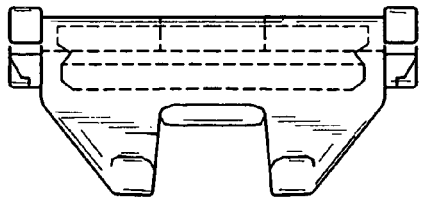
FIG. 5 is a bottom end elevational view of the golf accessory of the invention.
Figure 6:
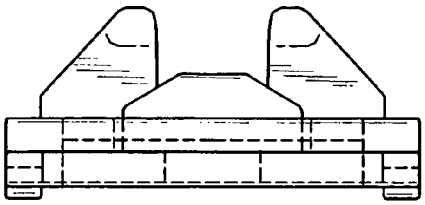
FIG. 6 is a top end elevational view of the golf accessory of the invention.
Figure 8:
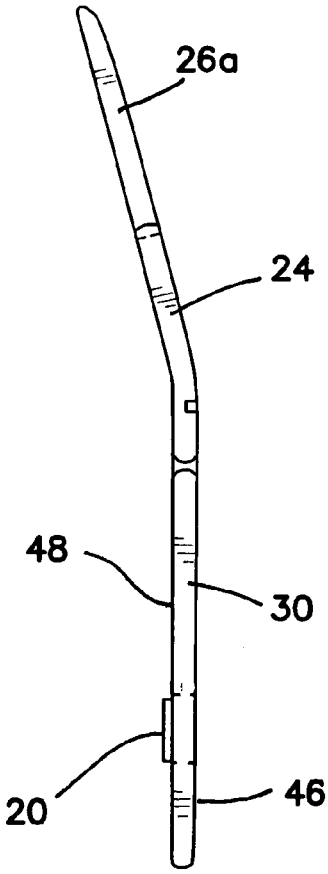
FIG. 8 is a right or left side elevational view of the fixed plate of the golf accessory of the invention shown in isolation of the hinge.
Figure 10:
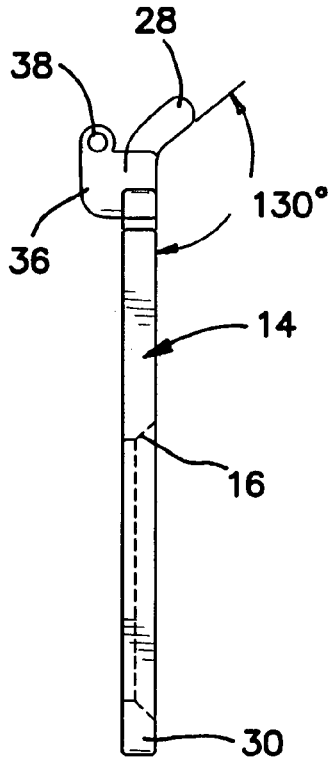
FIG. 10 is a right or left side elevational view of the hinged plate of the golf accessory of the invention shown in isolation of the fixed plate.

Fixed plate 12 as best shown in FIGS. 1, 3 and 8 is comprised of a single rigid piece having an upper body portion 30 and an angled lower body portion 24 which is divided into two descending legs 26*a* and 26*b* which serve as the divot tool. The angle defined between upper body portion 30 and lower body portion 24 is a matter of design choice, but in the preferred embodiment an angle of 165° has been found to provide a practical divot tool, where upper body portion 30 serves as the hand hold area and the digging elements are comprised of legs 26*a* and 26*b*. Tips 32 of legs 26*a* and 26*b* are shaped to provide a narrowed point to facilitate digging and ground penetration, but not to be so sharp as to provide any substantial risk of cutting the fingers of the user.

Figure 2:
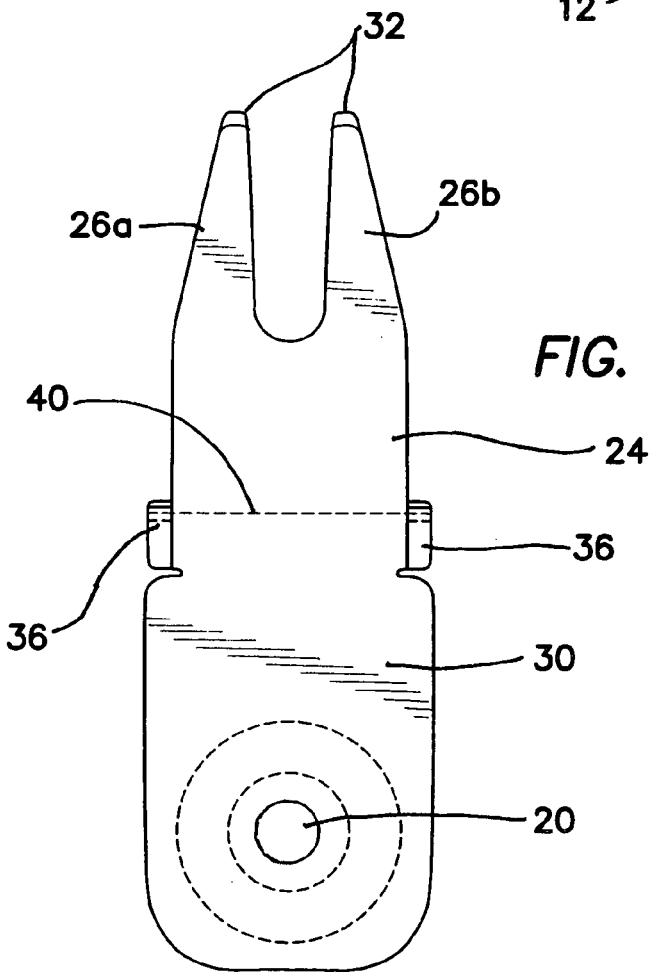
FIG. 2 is a back elevational view of the golf accessory of the invention.
Figure 7:
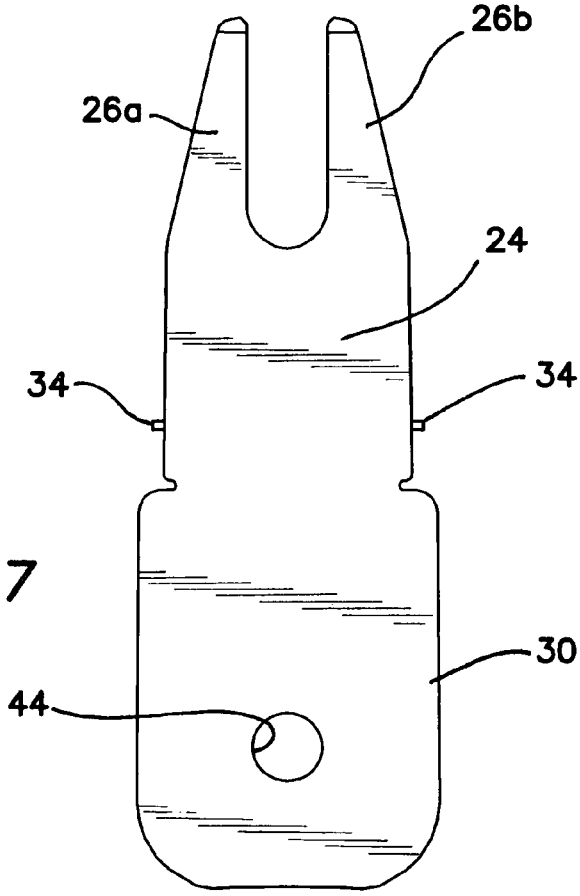
FIG. 7 is a back elevational view of the fixed plate of the golf accessory of the invention shown in isolation of the hinge.
Figure 9:
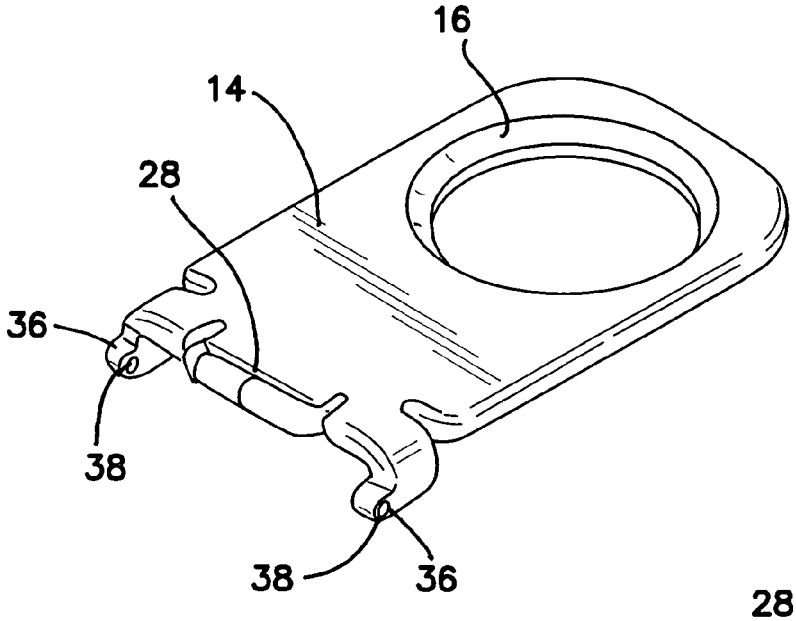
FIG. 9 is a perspective view of the hinged plate of the golf accessory of the invention shown in isolation of the fixed plate.

Hinged plate 14 rotates about a pair of pins 34 integrally cut with plate 12 as best seen in FIG. 7. The perspective view of FIG. 9 shows that the lower portion of hinged plate 14 is formed with bent arms 36 through which a hole 38 is defined. Arms 36 are bent around pins 34 of plate 12 as shown in FIGS. 2 and 3 so that pins 34 are disposed through holes 38 and arms 36 clasp or embrace the sides of upper portion 30 of plate 12. Hinged plate 14 rotates about the axis 40 symbolically depicted by the dotted line 40 in FIG. 2. Arms 36 thus serve to lock hinged plate 14 to fixed plate 12.

Hinged plate 14 is also cut and bent to provide a rigid angled tab 28 best seen in FIGS. 1, 3, 4 and 9. Tab 28 serves as a thumb lever whereby the user may apply a torque to hinged plate 14 to rotate it about axis 40 to an open position. Golf accessory 10 is shown in closed position in FIGS. 1, 3 and 4, but the illustrations of FIGS. 11 and 12 shown golf accessory 10 reconfigured to the open position. FIGS. 11 and 12 shows a cigar 42 resting in the dihedral angled formed between hinged plate 14 and fixed plate 12 when golf accessory 10 is reconfigured to the open position. In the open configuration tab 28 serves as a stop to limit the rotation of hinged plate 14 relative to fixed plate 12 and to maintain or support the open dihedral angle defined between them when a load is inserted into the dihedral angle. It can thus be appreciated that the magnitude of the dihedral angle defined between plates 12 and 14 is determined by the degree by with tab 28 is angled above the opposing surface of angled lower portion 24 as shown in FIG. 3, which also depends on the degree of inclination or angle between portions 24 and 30 of plate 12. In the illustrated embodiment the magnitude of the maximum distance of separation between the ends of plates 12 and 14 when fully opened is chosen to be approximately 1¼ inch, or the dihedral angle between the plates 12 and 14 varies between 0 to less than 90 degrees, but usually approximately 45 degrees. The maximum dihedral angle between plates 12 and 14 to provide the functionality to hold the cigar or other object between the plates will be dependant on the length of plates 12 and 14.

In the use shown in FIG. 11, magnet 20, as will be described below, extends through fixed plate 12 and is used as a means of magnetic attachment to any ferromagnetic surface, such as a golf club head when bagged or otherwise accessible, or a ferromagnetic portion of a golf cart. The extension of magnet 20 through hole 44 facilitates the magnetic attachment of magnet 20 when the rear surface 46 of golf accessory 10 is place in direct contact with a ferromagnetic surface.

In the same manner, golf accessory 10 can be staked into the ground or green as shown in FIG. 12 by driving legs 26*a* and 26*b* into the ground as the player putts out thereby holding the cigar 42 off the ground and maintaining it in a sanitary condition and unaffected by possibly wet grass surfaces. It is to be understood that the use of golf accessory 10 as a holder for objects is not limited to cigars, but includes any object such as, but not limited to, cigarettes, pipes and golf club shafts or grips of all sorts. For example, the grip of a putter can be laid into golf accessory 10 and kept clean and dry in the circumstance depicted in FIG. 12 to allow the player to handle the pin or other equipment and objects on the green.

In the preferred embodiment magnet 20 is a rivet shaped permanent magnet having sufficient magnetic strength to provide the attachment force needed for uses such as that illustrated in FIG. 11. A hole 44 is defined through upper portion 30 of fixed plate 12 as shown in FIG. 7. The magnet 20 is then formed with a post which is press fit through hole 44 and forms a substantially flush finish with the back surface 46 of upper portion 30 of fixed plate 12 as shown in FIG. 8. The reverse end of magnet 20 then extends from hole 44 in a flattened rivet shape as also seen in side view in FIG. 8. The diameter of magnet 20 is smaller than beveled recess 16 and ball marker 18 which is disposed and magnetically retained therein. Hence, ball marker 18 which is a thin flat disk sits centered on the slight height of magnet 20 extending from front surface 48 of upper portion 30. This allows the user to press down on an off-center position of ball marker 18, tipping it on its magnetic pedestal provided by magnet 20 extending from front surface 48 and facilitating the user's ability to grasp ball marker 18 and to slide it from beveled recess 16. The beveling of the peripheral edge of recess 16 assists in allowing the user to push ball marker 18 radially up and out of recess 16 after it has been tipped up onto the beveled peripheral edge.

Many alterations and modifications may be made by those having ordinary skill in the art without departing from the spirit and scope of the invention. For example, Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. A golf accessory usable in combination with a ferromagnetic surface and in combination as a rest for an object comprising:

a fixed plate defining at least one descending leg serving as a divot tool;

a hinged plate rotatably coupled to the fixed plate;

a rigid tab extending from the hinged plate and being rotatable to be positionable in contact against the fixed plate to act as a lever to assist in rotation of the hinged plate and to act as a stop to define a fixed dihedral angle between the fixed and hinged plates when in an open configuration to serve as the rest for the object;

a magnet disposed through the fixed plate for providing magnetic attachment of the fixed plate to the ferromagnetic surface; and a ball marker magnetically coupled to the magnet.

2. The golf accessory of claim 1 where the fixed plate has a front and back surface and where the magnet is disposed through the fixed plate to provide an available magnetic surface of direct contact with the magnet on the back surface of the fixed plate.

3. The golf accessory of claim 1 where the fixed plate has a front and back surface and where the magnet is disposed above the front surface of the fixed plate to provide a pedestal to which the ball marker can be magnetically coupled.

4. The golf accessory of claim 2 where the magnet is disposed above the front surface of the fixed plate to provide a pedestal to which the ball marker can be magnetically coupled.

5. The golf accessory of claim 4 where the hinged plate has a beveled recess defined therethrough through which the magnet is exposed on the front surface of the fixed plate, through which beveled recess the ball marker is received and magnetically coupled to the magnet.

6. The golf accessory of claim 1 where the fixed and hinged plates are laser cut stainless steel plate, and further comprising a pair of pins formed on the fixed plate to which the hinged plate is rotatably coupled when assembled thereto.

7. The golf accessory of claim 6 where the hinged plate includes a pair of arms and is assembled onto the fixed plate by bending the pair of arms having pivot holes defined therein over the pair of pins.

8. The golf accessory of claim 1 where the fixed plate is comprised of a lower portion and an upper portion, where the hinged plate is assembled parallel to the upper portion, where the lower portion of the hinged plate is angled with respect to the upper portion in a predetermined direction, and where the tab is angled with respect to the hinged plate in the same predetermined direction at an angle of inclination than of the inclination of the lower and upper portions of the fixed plate, so that a defined dihedral angle is defined and supported between the hinged plate and the upper portion of the fixed plate when the golf accessory is configured in the open configuration.

9. The golf accessory of claim 1 where the fixed plate comprises two descending legs to serve as the divot tool.

10. The golf accessory of claim 1 where the object comprises a smoking product requiring maintenance of a sanitary condition.

11. The golf accessory of claim 1 where the object comprises a golf club grip.

12. A golf accessory usable in combination with a ferromagnetic surface, including a portion of a golf cart or bagged golf club, and in combination as a rest for an object comprising:

a fixed plate defining at least one descending leg serving as a divot tool;

a hinged plate rotatably coupled to the fixed plate;

a rigid tab extending from the hinged plate and being rotatable to be positionable in contact against the fixed plate to act as a lever to assist in rotation of the hinged plate and to act as a stop to define a fixed dihedral angle between the fixed and hinged plates when in an open configuration to serve as the rest for the object;

a magnet disposed through the fixed plate for providing magnetic attachment of the fixed plate to the ferromagnetic surface where the fixed plate has a front and back surface and where the magnet is disposed through the fixed plate to provide an available magnetic surface of direct contact with the magnet on the back surface of the fixed plate; and a ball marker magnetically coupled to the magnet disposed above the front surface of the fixed plate to provide a pedestal to which the ball marker can be magnetically coupled.

13. The golf accessory of claim 12 where the hinged plate has a beveled recess defined therethrough through which the magnet is exposed on the front surface of the fixed plate, through which beveled recess the ball marker is received and magnetically coupled to the magnet.

14. The golf accessory of claim 12 where the fixed and hinged plates are laser cut stainless steel plate, and further comprising a pair of pins formed on the fixed plate to which the hinged plate is rotatably coupled when assembled thereto.

15. The golf accessory of claim 14 where the hinged plate includes a pair of arms and is assembled onto the fixed plate by bending the pair of arms having pivot holes defined therein over the pair of pins.

16. The golf accessory of claim 12 where the fixed plate is comprised of a lower portion and an upper portion, where the hinged plate is assembled parallel to the upper portion, where the lower portion of the hinged plate is angled with respect to the upper portion in a predetermined direction, and where the tab is angled with respect to the hinged plate in the same predetermined direction at an angle of inclination than of the inclination of the lower and upper portions of the fixed plate, so that a defined dihedral angle is defined and supported between the hinged plate and the upper portion of the fixed plate when the golf accessory is configured in the open configuration.

17. The golf accessory of claim 12 where the fixed plate comprises two descending legs to serve as the divot tool.

18. A golf accessory usable in combination with a ferromagnetic surface, including a portion of a golf cart or bagged golf club, and in combination as a rest for an object comprising:

a fixed plate defining at least one angled descending leg serving as a divot tool;

a hinged plate rotatably coupled to the fixed plate;

an angled rigid tab extending from the hinged plate to act as a lever to assist in rotation of the hinged plate and being rotatable to come in contact against the fixed plate to act as a stop to define a fixed dihedral angle between the fixed and hinged plates when in an open configuration to serve as the rest for the object;

a magnet disposed through the fixed plate for providing magnetic attachment of the fixed plate to the ferromagnetic surface where the fixed plate has a front and back surface and where the magnet is disposed through the fixed plate to provide an available magnetic surface of direct contact with the magnet on the back surface of the fixed plate; and a ball marker magnetically coupled to the magnet.

19. The golf accessory of claim 18 where the magnet is disposed above the front surface of the fixed plate to provide a pedestal to which the ball marker can be magnetically coupled.

20. The golf accessory of claim 18 where the fixed and hinged plates are laser cut stainless steel plate, and further comprising a pair of pins formed on the fixed plate to which the hinged plate is rotatably coupled when assembled thereto, and where the hinged plate includes a pair of arms and is assembled onto the fixed plate by bending the pair of arms having pivot holes defined therein over the pair of pins.

* * * * *